United States Patent [19]

Snellman et al.

[11] Patent Number: 4,922,990

[45] **Date of Patent: * May 8, 1990**

[54] PRESS SECTION FRAME IN A PAPER MACHINE

[75] Inventors: Yrjö Snellman, Tampere; Mauri Rantala, Nokia, both of Finland

[73] Assignee: Oy Tampella Ab, Tampere, Finland

[ * ] Notice: The portion of the term of this patent subsequent to Nov. 7, 2006 has been disclaimed.

[21] Appl. No.: 244,881

[22] Filed: Sep. 15, 1988

[30] Foreign Application Priority Data

Sep. 15, 1987 [FI] Finland ..... 874002

[51] Int. Cl.[5] ..... D21F 3/02

[52] U.S. Cl. ..... 162/273; 162/305; 162/360.1; 162/274

[58] Field of Search ..... 162/305, 358, 360.1, 162/272–274

[56] References Cited

U.S. PATENT DOCUMENTS

| | | | |
|---|---|---|---|
| 1,851,941 | 3/1932 | Broadhurst | 162/273 |
| 4,440,598 | 4/1984 | Koski et al. | 162/360.1 |
| 4,450,630 | 5/1984 | Phelps | 162/273 |
| 4,525,241 | 6/1985 | Laapotti | 162/360.1 |
| 4,608,125 | 8/1986 | Autio | 162/360.1 |
| 4,657,634 | 8/1987 | Autio | 162/360.1 |

FOREIGN PATENT DOCUMENTS

| | | |
|---|---|---|
| 73025 | 4/1987 | Finland . |
| 270549 | 9/1950 | France . |
| 671032 | 4/1952 | United Kingdom . |

OTHER PUBLICATIONS

"Paper Machine Felts & Fabrics," Albany International, 1976, FIG. 2–2 and p. 8.

A b b 15: Pressenpartie für Linerboard mit Flexonip--Presse, entitled "Erste Erfahrungen mit der Flexonip--Presse in der PM 6 in Nettingsdorf", 1984.

*Primary Examiner*—Karen M. Hastings

*Attorney, Agent, or Firm*—Pollock, Vande Sande & Priddy

[57] ABSTRACT

The invention relates to the press section in a paper machine. It comprises a roll combination (1–5), the rolls of which form one or a plurality of nips (N1, N2, N3). In addition, the press section comprises members for guiding the paper web through the press section and members for guiding one or a plurality of felts (6, 7) or the equivalent through the press section. The frame construction connected to the press section comprises a front frame (8), a rear frame (9) and an intermediate frame (10) connecting these two from above the press section. At least one roll of the roll combination (3, 5) provided in the press section is fixed to the auxiliary frame (13, 14), which is disposed to be rotatable about a shaft (19, 20). The auxiliary frame additionally comprises members (15, 16), by means of which the auxiliary frame (13, 14) can be detachably locked to the intermediate frame (10).

3 Claims, 1 Drawing Sheet

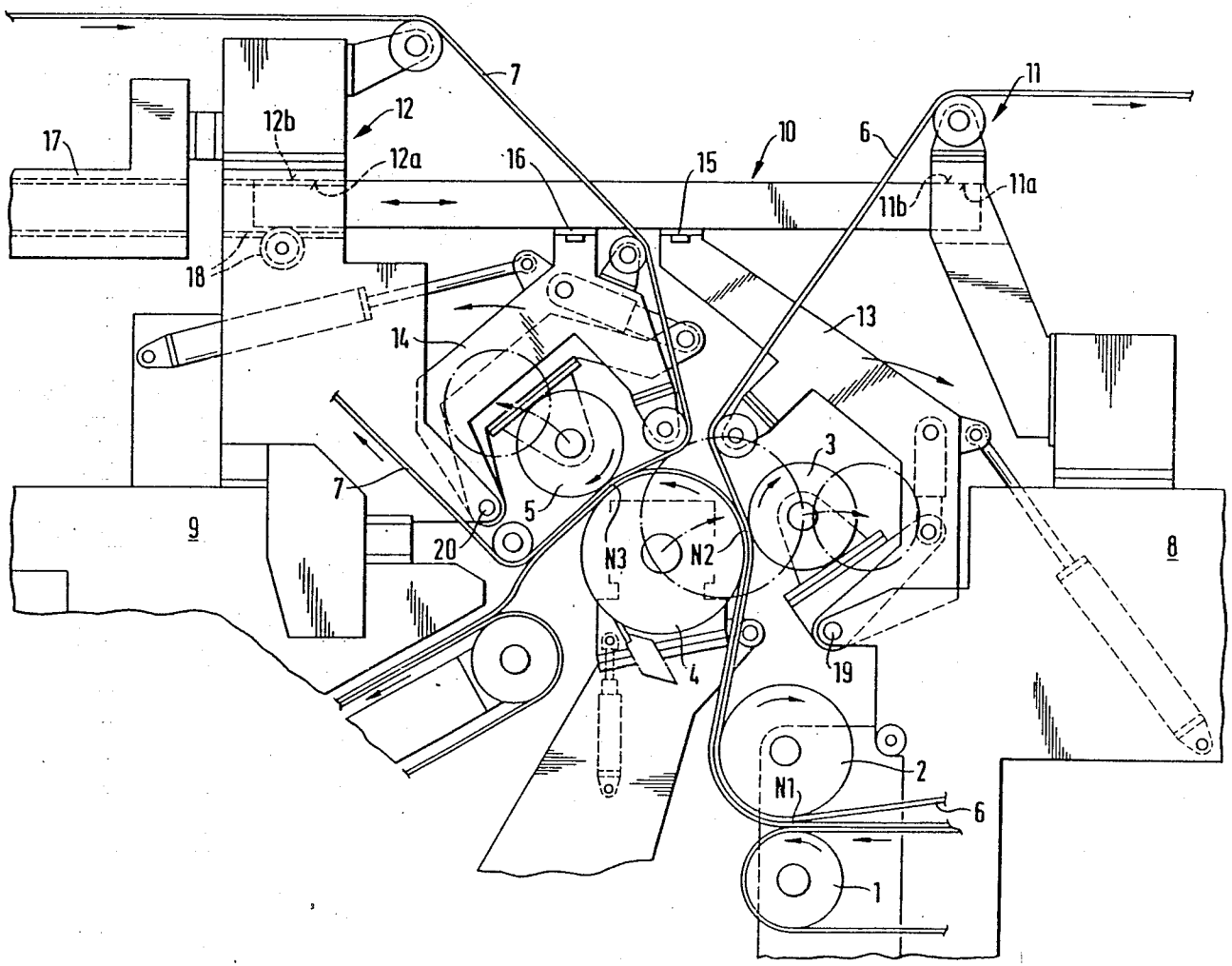
11
11a
11b
6
10
15
16
7
12
12a
12b
17
18
13
14
8
9
3
19
2
1
N1
N2
N3
4
5
20

PRESS SECTION FRAME IN A PAPER MACHINE

BACKGROUND OF THE INVENTION

The present invention relates to the press section of a paper machine comprising a roll combination, the rolls of which form at least one nip, members for guiding the paper web through the press section and members for guiding at least one felt or the equivalent through the press section, the frame construction connected to the press section including a front frame and a rear frame.

Constructions of this type are used to some extent nowadays.

Beloit Corporation has proposed the so-called "FLIP-TOP"-frame construction. In this construction, a two-piece intermediate frame is disposed above the press section of the paper machine to connect the front and rear frames of the press section. During the operation of the press section, the ends of the intermediate frame are fixed both to the front and the rear frame. Either of these attachments can be detached and the detached portion of the intermediate frame can be pivoted into the center of the intermediate frame, around the transverse articulated shaft of the paper machine. The partial opening of the intermediate frame has the purpose of facilitating the felt exchange on the press section. The "FLIP-TOP"-frame construction does not essentially improve other functions relating in particular to the service or operability of the press section.

Valmet Oy has proposed several frame constructions of the press section. The so-called SYM-PRESS press section is known, in which horizontal beams providing a solid connection of the front and rear frames of the press section are disposed above the press rolls in a compact press section, both on the service and the driving side of the paper machine. This structure is difficult in particular with regard to the services of the press section, since the beams, being stationary above the press section, hamper and delay the service operations. The further development of this frame construction has resulted in the frame described in the Finnish patent applications 844693 and 854959 of Valmet Oy. These publications disclose intermediate frame constructions, in which a one-piece intermediate frame is pivotally articulated to the rear frame of the press section and disposed to be detachably fixed to the front frame (FI-844693), or alternatively, the intermediate frame consists of two pieces, the pieces being articulated into the front frame on the one hand and into the rear frame on the other hand (FI-854959). The free ends of the pieces of the intermediate frame are fixed to the fixed intermediate part of the intermediate frame (FI-854959). The intermediate frames described above are pivotable around their articulating points in the vertical plane partly away from above the roll arrangement of the press section in particular in view of service operations. It is difficult to make this type of constructions sufficiently solid and thus vibrationless.

The constructor of the press section of a modern paper machine has to fulfill two opposite requirements. On the one hand, the frame construction of the press section, the front frame, the rear frame and the intermediate frame connecting these two, should form a sufficiently rigid construction, which, during the operation of the press section, ensures a trouble-free operation of the press section. However, on the other hand, the compact press section, the machine elements of which such as press rolls, felts and members for guiding the web, are located very close to each other in the operating position, should, in view of the necessary frequent services of the paper machine, have a construction that allows to perform efficiently the service operations . This means that the press section should be openable to a necessary extent relatively easily and the above machine elements should be easily accessible in such an opened position.

SUMMARY OF THE INVENTION

The object of the present invention is to provide a press section that fulfills the requirements described above. The press section according to the invention is rigid in the operating position and on the other hand it allows the machine elements in the press section to be easily and rapidly serviced.

In order to achieve this purpose, the press section according to the present invention comprises at least one auxiliary frame, to which at least one member, such as a roll of the roll combination, is fixed, and in the front and rear frames of the frame construction are connected by an intermediate frame, to which the auxiliary frame is connected. The intermediate frame provides a structural connection of the front and rear frame into a rigid frame assembly when the press section is in operating position. The press section is brought into service position by removing the intermediate frame from above the roll combination by lifting, turning or displacing, upon which the auxiliary frame can be opened into the open position for service.

BRIEF DESCRIPTION OF THE DRAWINGS

The invention is illustrated in the following description with reference to the enclosed drawing, which presents the press section and its frame construction in a schematic lateral view.

DETAILED DESCRIPTION OF THE PREFERRED EMBODIMENT(S)

The frame construction of the press section represented in the drawing comprises the roll combination of rolls 1, 2, 3, 4 and 5, which form the three nips N1, N2 and N3. The press section further comprises members for guiding the paper web through the press section and members for guiding one or a plurality of felts 6,7 into contact with the press section. The frame construction comprises the front frame 8, the rear frame 9 and the intermediate frame 10 connecting these two from above the press section. Since the actual structural makeup of the press section does not enter into the scope of the invention, it will not be described in detail here. It is merely noted that in the frame construction according to the invention all prior known press sections are applicable with regard to the roll combination and the other machine elements. The intermediate frame 10 comprises at least one beam 10 disposed in the longitudinal direction of the paper machine. The intermediate frame can be disposed on both sides of the paper machine. The beams can form one integral assembly or can be disposed separately. At both ends of the intermediate frame 10 members 11*a*, 12*a*, are provided, which cooperate to provide an interlocking with the countermembers 11*b* in the front frame 8 , and with the countermembers 12*b* in the rear frame 9 . This type of interlocking members can be constructed according to principles that are known to a person skilled in the art, and consequently their detailed construction will not be described here. Due to the joints 11 and 12 formed by the members 11*a*, 11*b*; 12*a*, 12*b*, a rigid assembly of the frame construction is achieved in the operating position.

The intermediate frame 10 is removable from above the roll combination of rolls 1 to 5. The removal is effected essentially horizontally. In the described embodiment this displacement is performed in the longitudinal direction of the paper machine. For this purpose support means 17 are disposed in the removal direction of the intermediate frame, in the described embodiment on the level of the rear frame 9 essentially on the same height level as the intermediate frame 10, onto which support means the intermediate frame 10 is transferred when removed from the roll combination. Moreover, on the removal side of the intermediate frame 10, in the rear frame 9, transfer means 18 connected with the intermediate frame 10 are disposed, by means of which the intermediate frame is transferred from the roll combination into contact with the support means 17 and vice versa.

The intermediate frame construction described above is one way of implementing the present invention.

In the embodiment illustrated in the drawing, the two rolls 3 and 5 included in the press section are both fixed to separate auxiliary frames 13, 14. The auxiliary frames 13, 14 are supported onto the shafts 19 and 20, which are fixed to the front frame 8 through shaft 19 and to the rear frame 9 through shaft 20. The ends of the auxiliary frames 13, 14 opposite with regard to the above points of attachment are detachably fixed to the intermediate frame (10) by the fixing members 15, 16.

In addition, the felt rolls 21 and 22 are fixed to the auxiliary frames, the guide roll 21 to the first auxiliary frame 13 and the guide roll 22 to the second auxiliary frame 14. The shaft 19 of the first auxiliary frame 13 is fixed to the front frame 8 and the first auxiliary frame 13 is rotatable in the vertical plane about the shaft 19 into the open position in order to open up the press section. Correspondingly, the shaft 20 of the second auxiliary frame 14 is fixed to the rear frame 9 and the second auxiliary frame 14 is rotatable in the vertical plane about the shaft 20 in the open position in order to open up the press section.

The press section can of course comprise one, two or a plurality of auxiliary frames according to the invention. The members fixed to the auxiliary frame can also vary in a manner characteristic of the press section construction involved. It is further possible that the intermediate frame is removable in some other way than by displacing it in the direction of the frame. The intermediate frame can, for instance, be fixed onto bearings either to the front or the rear frame, whereby the upper side of the press section is opened up by rotating the frame around the point of bearing or merely by lifting away the intermediate frame by means of a crane, or by dividing the intermediate frame for example into a two-piece frame and fixing the pieces pivotally onto bearings to both the front and the rear frame.

We claim:

1. A press section in a paper machine, comprising:

a roll combination of at least two rolls which form at least one press nip, members for guiding the paper web through the press section and members for guiding at least one felt into contact with the press section; and a frame construction including a front frame positioned before said roll combination;

a rear frame positioned behind said roll combination;

an intermediate frame comprising at least one substantially horizontal beam located on a level and extending between said front and said rear frame and above said roll combination; and at least one auxiliary frame located below said intermediate frame and carrying at least one roll of said roll combination;

said auxiliary frame being connected by a shaft to one of said front or rear frames and arranged rotatably around said shaft;

connecting means provided on said front and rear frames and corresponding connecting means provided on said intermediate frame for detachable interconnecting said intermediate frame to said front and rear frames;

locking means provided on said intermediate frame and corresponding locking means provided on said auxiliary frame for detachably interlocking said auxiliary frame to said intermediate frame, during the operating process of the press;

transfer means for moving said intermediate frame horizontally in a longitudinal direction of the paper machine between an operating position in which said intermediate frame is interconnected above said roll combination to a service position in which said intermediate frame is detached from above said front and rear frames and removed from above said roll combination; and a support means located on the same level as said at least one substantially horizontal beam and connected to said front or rear frames, for receiving and supporting said intermediate frame in said service position.

2. A press section in a paper machine according to claim 1 comprises two auxiliary frames, the first of which is fixed by a first shaft to said front frame, and the second of which is fixed by a second shaft to said rear frame.

3. A press section in a paper machine according to claim 1, wherein a felt guide roll is fixed to said auxiliary frame.

* * * * *